US008439174B1

(12) United States Patent
Miranda

(10) Patent No.: US 8,439,174 B1
(45) Date of Patent: May 14, 2013

(54) COMBINED SUITCASE AND CUSHION APPARATUS

(76) Inventor: Susan L. Miranda, Santa Clarita, CA (US)

( * ) Notice: Subject to any disclaimer, the term of this patent is extended or adjusted under 35 U.S.C. 154(b) by 84 days.

(21) Appl. No.: 13/014,571

(22) Filed: Jan. 26, 2011

(51) Int. Cl.
*A45C 5/14* (2006.01)

(52) U.S. Cl.
USPC ..... 190/2; 190/1; 190/18 A; 383/4

(58) Field of Classification Search ..... 190/2, 111, 190/903, 1; 383/3, 4; 5/420, 626; 224/156
See application file for complete search history.

(56) References Cited

U.S. PATENT DOCUMENTS

| | | | | |
|---|---|---|---|---|
| 3,818,962 | A * | 6/1974 | Muller-Scherak | 383/3 |
| 4,742,900 | A | 5/1988 | Boxhammer | |
| 5,291,324 | A * | 3/1994 | Hinterlong | 398/54 |
| 5,611,414 | A | 3/1997 | Walker | |
| 5,630,237 | A * | 5/1997 | Ku | 5/420 |
| 5,785,219 | A | 7/1998 | Kraft | |
| 5,875,876 | A * | 3/1999 | Wang | 190/18 A |
| 6,186,380 | B1 * | 2/2001 | Grounds | 224/156 |
| 6,463,604 | B1 | 10/2002 | Reveron et al. | |
| 2002/0074251 | A1 * | 6/2002 | Hirshberg | 206/315.1 |
| 2002/0088679 | A1 * | 7/2002 | Abraham | 190/111 |
| 2008/0087513 | A1 * | 4/2008 | Majeau | 190/111 |
| 2009/0008203 | A1 * | 1/2009 | King et al. | 190/111 |
| 2009/0014349 | A1 * | 1/2009 | Lee | 206/522 |
| 2009/0139814 | A1 * | 6/2009 | Grossman et al. | 190/18 A |
| 2009/0276957 | A1 * | 11/2009 | Boitet-Ball | 5/420 |
| 2011/0056788 | A1 * | 3/2011 | Jackson | 190/2 |

* cited by examiner

*Primary Examiner* — Sue A Weaver

(57) ABSTRACT

The combined suitcase and cushion apparatus provides a typical appearance for a portable suitcase, exteriorly. Within the top section provided by the first closure the second closure allows flap opening to reveal and release the mat. The mat is extendable from the top section to provide a cushioning material disposed above an inflatable chamber. Combining both forgiving resilient features provides a much more comfortable mat. Importantly, the first closure allows selective total separation of the top section. With this feature, the top section can be retained or separated for mat use. The apparatus provides all portability features to which users have become accustomed.

3 Claims, 5 Drawing Sheets

COMBINED SUITCASE AND CUSHION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Many times travel exposes people to hardships wherein rest is either desirable or needed. Simply viewing patrons stranded in an airport for seemingly endless hours reinforces the need for a means to carry some sort of cushioning device, as crowding in such instances is given. But, carrying additional items, beyond a suitcase and maybe even computer, exposes a traveler to greater transport hardships. For one, with airport security forcing patrons to check baggage beyond carry-on limits, there is little chance or carrying what may be needed to ensure comfort. Second, even if carrying some form of cushion is possible, doing so is hardly practical in most instances. The present apparatus provides a unique solution to such problems.

FIELD OF THE INVENTION

The combined suitcase and cushion apparatus relates to portable beds and also suitcases and more especially to a combined suitcase with selectively employed cushion.

SUMMARY OF THE INVENTION

The general purpose of the combined suitcase and cushion apparatus, described subsequently in greater detail, is to provide a combined suitcase and cushion apparatus which has many novel features that result in an improved combined suitcase and cushion apparatus which is not anticipated, rendered obvious, suggested, or even implied by prior art, either alone or in combination thereof.

To attain this, the combined suitcase and cushion apparatus provides a typical appearance for a portable suitcase, exteriorly. Within the top section, which can be separated from the suitcase and is completely surrounded by a first closure, there is a second closure that forms a flap which opens to reveal and release a pliable, inflatable mat. Importantly, the first closure permits selective total separation of the top section by which the top section can be retained or separated for mat use. The apparatus provides all portability features to which users have become accustomed. While the apparatus may be provided in various sizes, the dimensions of the preferred embodiment are critical to function for many travelers. The preferred embodiment features a length of 22 inches, the width of 14 inches, and the height of 9 inches which are maximum allowable dimensions for most air travel carry-on items.

Thus has been broadly outlined the more important features of the improved combined suitcase and cushion apparatus so that the detailed description thereof that follows may be better understood and in order that the present contribution to the art may be better appreciated.

An object of the combined suitcase and cushion apparatus is to provide a combined function apparatus for a traveler.

Another object of the combined suitcase and cushion apparatus is to provide a combined device while retaining suitcase functionality.

A further object of the combined suitcase and cushion apparatus is to meet travel restriction requirements.

An added object of the combined suitcase and cushion apparatus is to provide an included cushioned mat that provides substantial comfort.

And, an object of the combined suitcase and cushion apparatus is to be visually indistinguishable from other suitcases with the cushion not in use.

Yet another object of the combined suitcase and cushion apparatus is to be highly portable.

These together with additional objects, features and advantages of the improved combined suitcase and cushion apparatus will be readily apparent to those of ordinary skill in the art upon reading the following detailed description of presently preferred, but nonetheless illustrative, embodiments of the improved combined suitcase and cushion apparatus when taken in conjunction with the accompanying drawings.

DETAILED DESCRIPTION OF THE DRAWINGS

With reference now to the drawings, and in particular FIGS. 1 through 5 thereof, the principles and concepts of the combined suitcase and cushion apparatus generally designated by the reference number 10 will be described.

Figure 1:
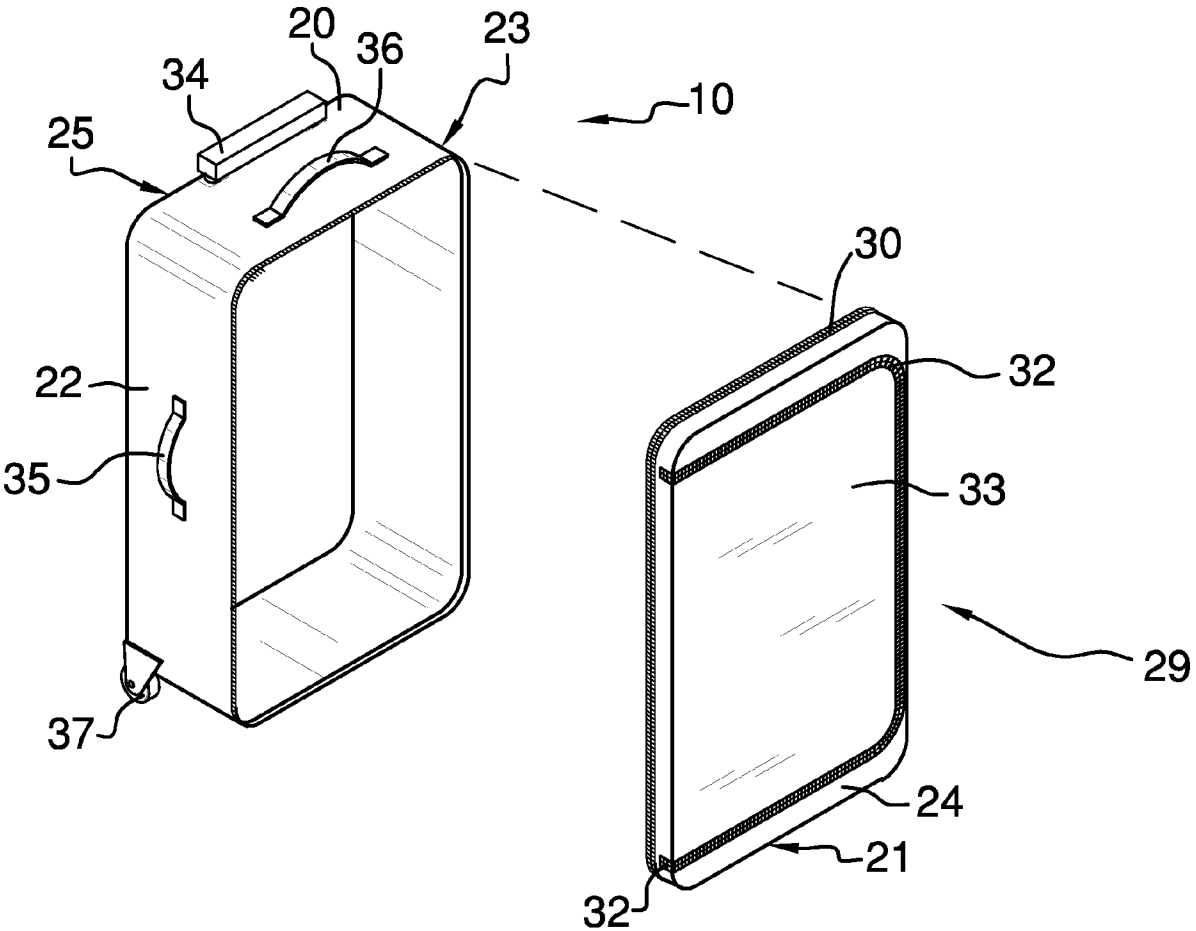
FIG. 1 is a top first side perspective view of an embodiment showing a portion of a second closure disposed proximal the right side.

Referring to FIG. 1, the apparatus 10 partially comprises a top end 20 spaced apart from a bottom end 21, a left side 22 spaced apart from a right side 23, a front side 24 spaced apart from a rear side 25.

Figure 5:
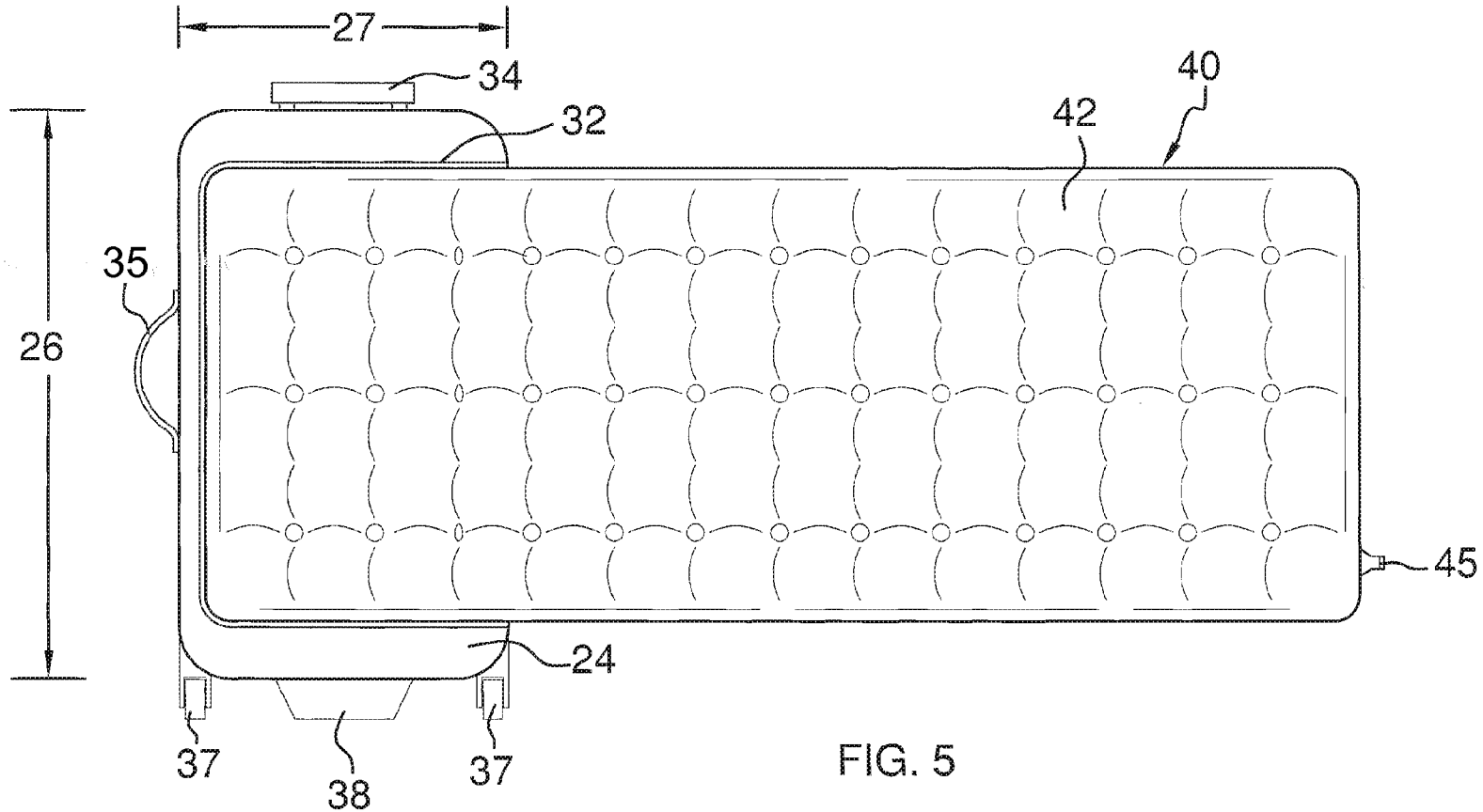
FIG. 5 is a top plan view with mat fully extended.

Referring to FIG. 5, the apparatus 10 further comprises a length 26 of about 22 inches, and a width 27 of about 14 inches.

Figure 2:
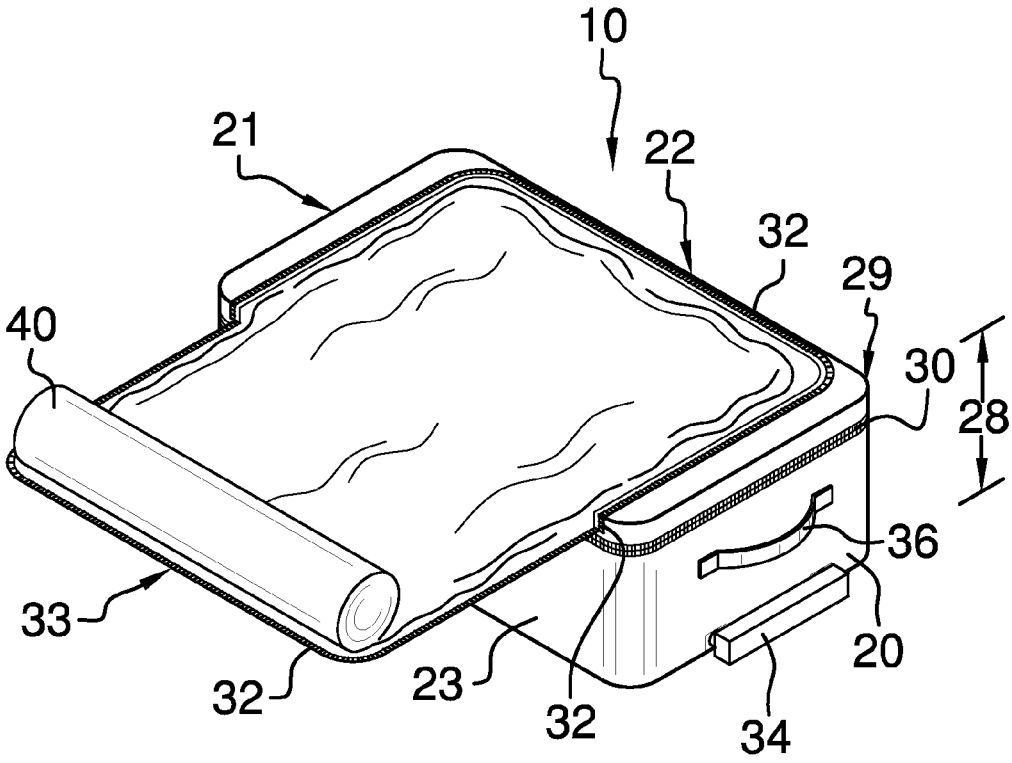
FIG. 2 is a top second side perspective view of a second embodiment showing a portion of the second closure disposed proximal the left side, with a flap opened and a mat partially extended.

Referring to FIG. 2, the apparatus 10 further comprises a height 28 of about 9 inches.

Referring again to FIG. 5, the pair of spaced apart casters 37 is disposed on the bottom end 21. The casters 37 are disposed adjacent to the rear side 25. The rest 38 is extended centrally from the bottom end 21 and is proximal to the front side 24.

Referring again to FIG. 2, the telescopic handle 34 is disposed within the top end 20 adjacent to the rear side 25. The first loop handle 35 is disposed centrally on the let side 22.

Referring to FIG. 1, the second loop handle 36 is disposed centrally on the top end 20.

Referring to FIGS. 1 and 2, a first closure 30 is continuously disposed along a periphery between the front side 24 and each of the top end 20, the bottom end 21, the left side 22, and the right side 23. The first closure 30 allows complete separation of a top section 29. A generally U-shaped second closure 32 is disposed on the front side 24 and has a portion parallel to each of the top end 20, the bottom end 21, and one of the left side 22, as depicted in one embodiment shown FIGS. 2 through 5, and the right side 23, as depicted in another embodiment shown in FIG. 1. This configuration allows a flap 33 to be formed within the second closure 32 on the front side 24 in the top section 29 and allows a mat 40 to be freely extended from the top section 29 toward either the left side 22 or the right side 23. The second closure 32 further has two outer ends 39, wherein each outer end 39 is disposed proximal to one of the left side 22 and the right side 23.

Figure 3:
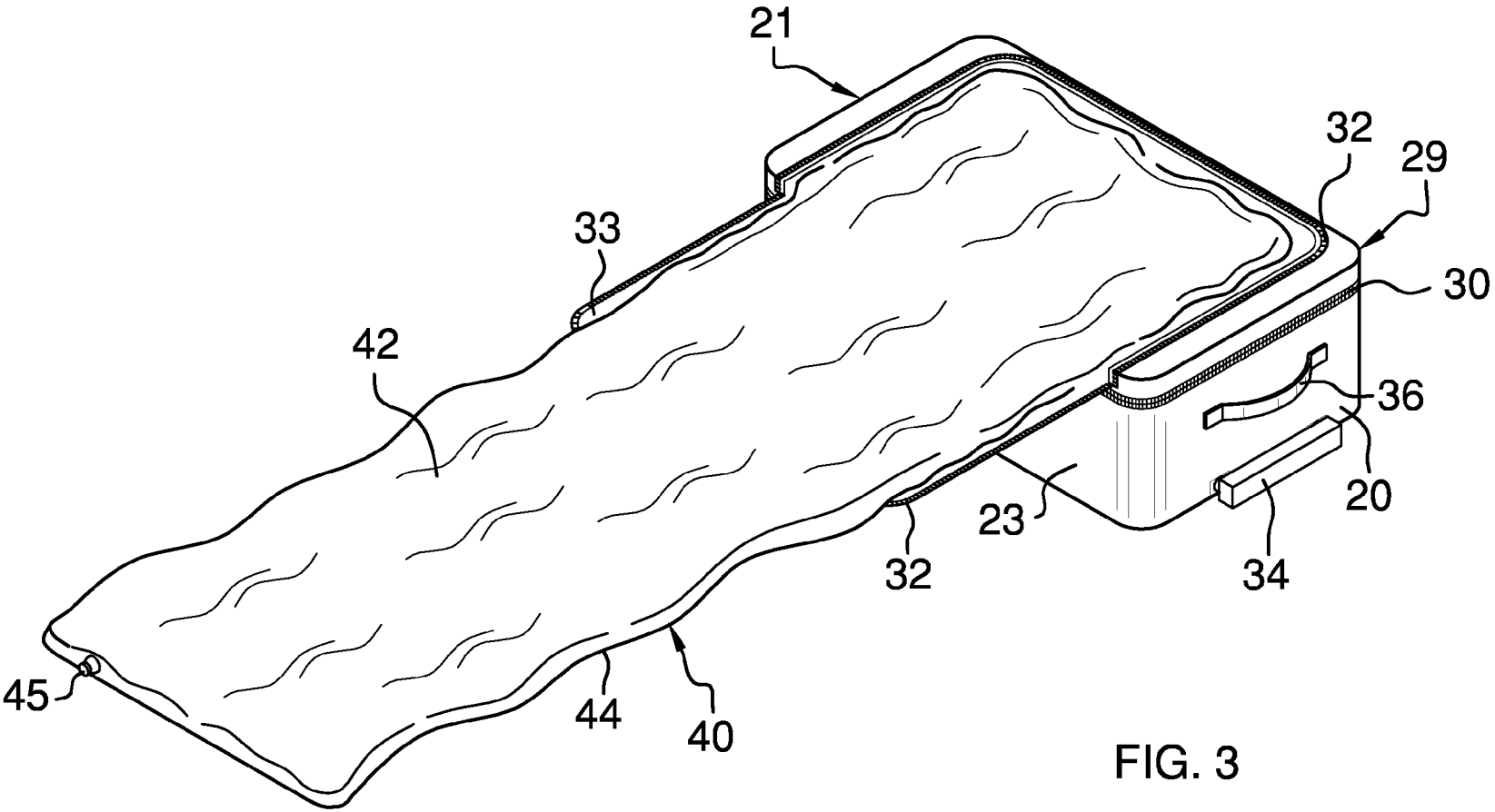
FIG. 3 is a perspective view of FIG. 2, mat fully extended.

Referring to FIG. 3, the pliable mat 40 is removably disposed within the top section 29. The mat 40 is attached to the flap 33. The mat 40 is selectively extended beyond the top 24 and the flap 33. The mat 40 comprises a wrinkled top surface 42. The mat also includes an inflatable chamber 44.

Figure 4:
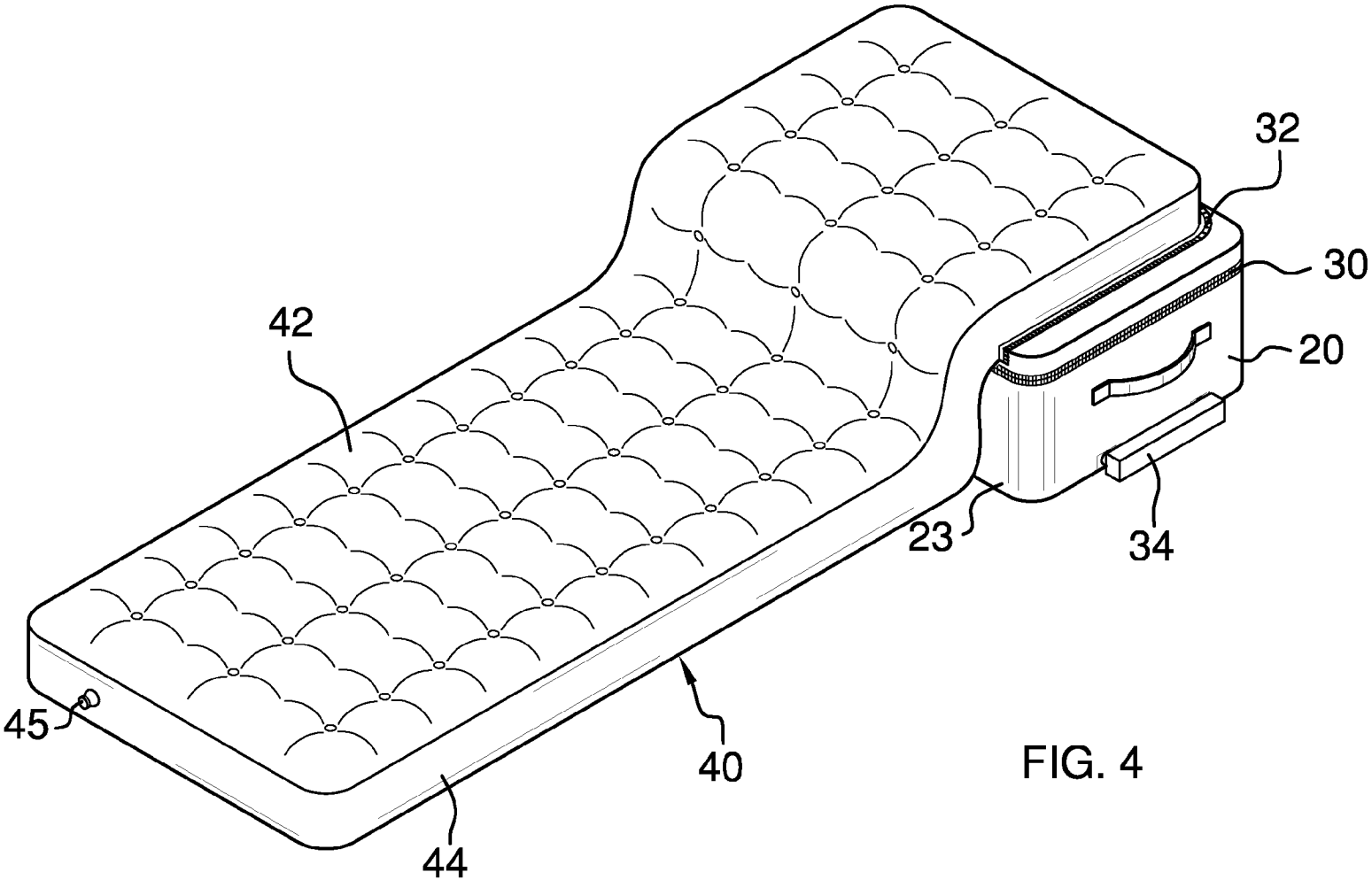
FIG. 4 is a perspective view of FIG. 3, mat fully extended and chamber inflated.

Referring to FIG. 4, the mat 40 has been extended and the inflation device 45 used to inflate the chamber 44. Deflation of the chamber 44 allows replacement of the mat 40 within the flap 33 and into the top section 29.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the combined suitcase and cushion apparatus may be used.

What is claimed is:

1. A combined suitcase and cushion apparatus comprising:

a top end spaced apart from a bottom end, a left side spaced apart from a right side, a front side spaced apart from a rear side;

a first closure continuously disposed along a periphery between the front side and each of the top end, the bottom end, the left side, and the right side;

a generally U-shaped second closure disposed on the front side, the second closure having a portion parallel to each of the top end, the bottom end, and a respective one of the left side and the right side, and further having two outer ends, wherein each outer end is disposed proximal either the right side or the left side;

wherein a flap is formed between the portions of the second closure on the front side and a respective one of the right side and the left side;

a pliable mat removably disposed within the top section, the mat attached to the flap, the mat selectively extended beyond the front side and the flap, the mat comprising:
a wrinkled top surface; and
an inflatable chamber.

2. A combined suitcase and cushion apparatus comprising:

a top end spaced apart from a bottom end, a left side spaced apart from a right side, a front side spaced apart from a rear side;

a pair of spaced apart casters disposed on the bottom end, the casters disposed adjacent to the rear side;

a rest extended centrally from the bottom end, the rest proximal to the front side;

a telescopic handle disposed within the top end adjacent to the rear side;

a first loop handle disposed centrally on the left side;

a second loop handle disposed centrally on the top end;

a first closure continuously disposed along a periphery between the front side and each of the top end, the bottom end, the left side, and the right side;

a freely removable top section completely surrounded by the first closure;

a generally U-shaped second closure disposed on the front side, the second closure having a portion parallel to each of the top end, the bottom end, and a respective one of the left side and the right side, and further having two outer ends, wherein each outer end is disposed proximal either the right side or the left side;

wherein a flap is formed between the portions of the second closure on the front side and a respective one of the right side and the left side;

a pliable mat removably disposed within the top section, the mat attached to the flap, the mat selectively extended beyond the front side and the flap, the mat comprising:
a wrinkled top surface; and
an inflatable chamber.

3. A combined suitcase and cushion apparatus comprising:

a top end spaced apart from a bottom end, a left side spaced apart from a right side, a front side spaced apart from a rear side, a length not to exceed 22 inches, a width not to exceed 14 inches, and a height not to exceed 9 inches;

a pair of spaced apart casters disposed on the bottom end, the casters disposed adjacent to the rear side;

a rest extended centrally from the bottom end, the rest proximal to the front side;

a telescopic handle disposed within the top end adjacent to the rear side;

a first loop handle disposed centrally on the left side;

a second loop handle disposed centrally on the top end;

a first closure continuously disposed along a periphery between the front side and each of the top end, the bottom end, the left side, and the right side;

a freely removable top section completely surrounded by the first closure;

a generally U-shaped second closure disposed on the front side, the second closure having a portion parallel to each of the top end, the bottom end, and a respective one of the left side and the right side, and further having two outer ends, wherein each outer end is disposed proximal either the right side or the left side;

wherein a flap is formed between the portions of the second closure on the front side and a respective one of the right side and the left side;

a pliable mat removably disposed within the top section, the mat attached to the flap, the mat selectively extended beyond the front side and the flap, the mat comprising:
a wrinkled top surface; and
an inflatable chamber.

* * * * *